US010582786B1

(12) United States Patent
Saint Geours

(10) Patent No.: US 10,582,786 B1
(45) Date of Patent: Mar. 10, 2020

(54) DOUBLE CHAMBER BOTTLE ASSEMBLY

(71) Applicant: Alejandro Saint Geours, Canyon Country, CA (US)

(72) Inventor: Alejandro Saint Geours, Canyon Country, CA (US)

( * ) Notice: Subject to any disclaimer, the term of this patent is extended or adjusted under 35 U.S.C. 154(b) by 0 days.

(21) Appl. No.: 16/387,625

(22) Filed: Apr. 18, 2019

(51) Int. Cl.

| | |
|---|---|
| ***A47G 19/18*** | (2006.01) |
| ***B65D 1/04*** | (2006.01) |
| ***B65D 35/22*** | (2006.01) |
| ***B65D 1/32*** | (2006.01) |
| *A47G 19/12* | (2006.01) |

(52) U.S. Cl.
CPC ..... *A47G 19/183* (2013.01); *B65D 1/04* (2013.01); *B65D 1/32* (2013.01); *B65D 35/22* (2013.01); *A47G 2019/122* (2013.01)

(58) Field of Classification Search
CPC .. A47G 19/183; A47G 2019/122; B65D 1/04; B65D 1/32; B65D 35/22
USPC ..... 215/6; 220/23.83, 253, 525, 4.31; 222/142.9, 144.5, 145.2, 129, 94
See application file for complete search history.

(56) References Cited

U.S. PATENT DOCUMENTS 1,568,160 A * 1/1926 Hibbert ..... A47G 19/24 222/142.9
2,241,044 A * 5/1941 Birger ..... B65D 47/265 222/142.9
2,376,855 A * 5/1945 Hanley ..... A47G 19/24 222/142.3
3,003,665 A * 10/1961 Peters ..... A47G 19/24 222/94
3,076,573 A * 2/1963 Thomas ..... B65D 47/265 215/6
3,786,112 A 1/1974 Reusser, et al.
3,788,520 A * 1/1974 Dukess ..... B65D 35/22 222/94
4,148,417 A 4/1979 Simmons
4,380,307 A * 4/1983 Stillinger ..... B65D 47/265 222/142.9
4,846,374 A * 7/1989 Gabrys ..... B65D 47/265 222/153.09
5,316,159 A * 5/1994 Douglas ..... B65D 21/0204 206/432
5,318,203 A * 6/1994 Iaia ..... B65D 81/3288 222/94
5,758,786 A * 6/1998 John ..... A61J 9/00 215/11.1

(Continued)

*Primary Examiner* — Patrick M. Buechner
*Assistant Examiner* — Michael J. Melaragno

(57) ABSTRACT

A double chamber bottle assembly includes a first container that contains a fluid condiment and a second container that contains a fluid condiment. The second container releasably engages the first container such that the first and second containers form a bottle. A cap is rotatably coupled to each of the first and second containers and the cap has a plurality of dispensing apertures each extending therethrough. The cap is rotatable into a first open position to release the fluid condiment from the first container, a second open position to release the fluid condiment from the second container and a third open position to release both of the first and fluid condiments. A nozzle is coupled to the cap and the nozzle has a pair of chambers therein to receive, and subsequently dispense, the fluid condiment in the respective first and second containers.

6 Claims, 6 Drawing Sheets

(56) References Cited

U.S. PATENT DOCUMENTS 5,765,725 A * 6/1998 Matt ..... B65D 35/22 222/129
5,823,391 A * 10/1998 Klauke ..... B65D 35/22 222/94
D404,302 S * 1/1999 Martin ..... D9/524
5,921,440 A 7/1999 Maines
5,954,213 A * 9/1999 Gerhart ..... B65D 81/3288 206/514
5,954,231 A * 9/1999 Durliat ..... B65D 81/3227 222/1
6,063,223 A * 5/2000 Klauke ..... B65D 35/22 156/242
6,161,729 A * 12/2000 Gentile ..... B65D 47/2031 222/129
6,164,495 A * 12/2000 Manesis ..... A61F 9/0008 222/129
D439,156 S * 3/2001 Hall ..... D9/522
6,223,942 B1 * 5/2001 Markey ..... B65D 21/0204 222/485
RE38,328 E * 11/2003 Gueret ..... B05B 11/0029 222/1
6,685,041 B1 * 2/2004 Geisinger ..... B65D 81/3283 215/235
6,758,411 B2 * 7/2004 Conway ..... B65D 81/3288 215/10
6,857,530 B2 * 2/2005 Yourist ..... B65D 21/0202 215/10
6,971,551 B2 * 12/2005 Widgery ..... A47G 19/2266 222/129
6,994,818 B2 * 2/2006 Keller ..... B65D 81/3288 264/248
7,036,684 B1 5/2006 Hantman
7,258,251 B2 8/2007 Johnson
D566,576 S 4/2008 Thompson
7,665,631 B2 2/2010 Pikowski
D614,046 S * 4/2010 Piro ..... D9/450
7,946,452 B2 * 5/2011 Hantman ..... B29C 49/0078 215/10
9,872,587 B1 * 1/2018 DiPaolo ..... A47J 41/0055
2006/0043047 A1 * 3/2006 Johnson ..... A47G 19/183 215/6
2006/0108363 A1 * 5/2006 Yates, III ..... B65D 1/04 220/23.4
2007/0029275 A1 * 2/2007 Hantman ..... B29C 49/0078 215/6
2008/0121654 A1 * 5/2008 Pikowski ..... A47G 19/183 222/129
2011/0259914 A1 * 10/2011 Lee ..... B29C 53/40 222/94
2014/0263448 A1 * 9/2014 Erskine-Smith ..... B65D 35/22 222/143
2018/0312322 A1 * 11/2018 Canales Kell ..... B65D 1/04
2019/0039807 A1 * 2/2019 De Cleir ..... B65D 1/04

* cited by examiner

DOUBLE CHAMBER BOTTLE ASSEMBLY

CROSS-REFERENCE TO RELATED APPLICATIONS

Statement Regarding Federally Sponsored Research or Development

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to condiment bottle devices and more particularly pertains to a new condiment bottle device for storing and dispensing two different condiments either separately or simultaneously.

BRIEF SUMMARY OF THE INVENTION

An embodiment of the disclosure meets the needs presented above by generally comprising a first container that contains a fluid condiment and a second container that contains a fluid condiment. The second container releasably engages the first container such that the first and second containers form a bottle. A cap is rotatably coupled to each of the first and second containers and the cap has a plurality of dispensing apertures each extending therethrough. The cap is rotatable into a first open position to release the fluid condiment from the first container, a second open position to release the fluid condiment from the second container and a third open position to release both of the first and fluid condiments. A nozzle is coupled to the cap and the nozzle has a pair of chambers therein to receive the fluid condiment in the respective first and second containers.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
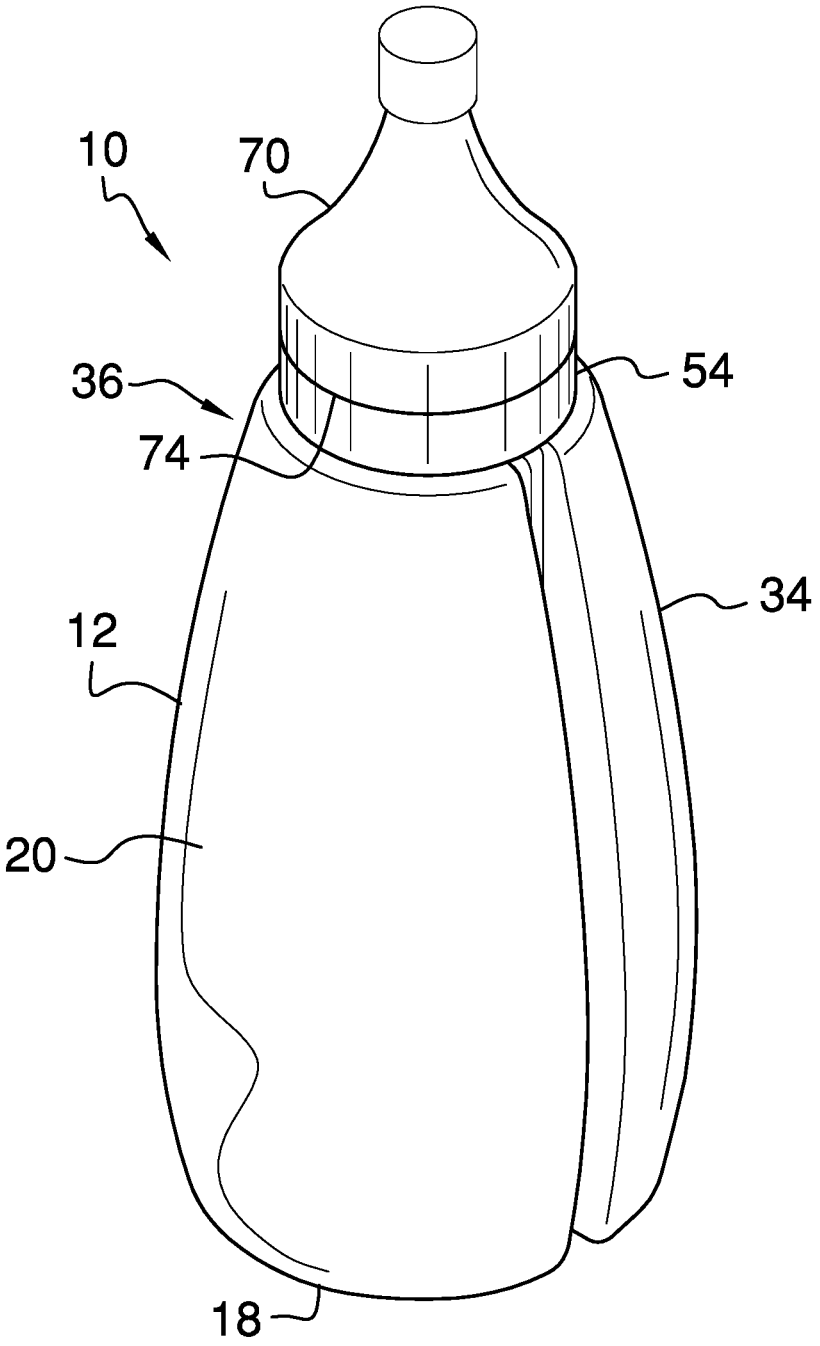
FIG. 1 is a perspective view of a double chamber bottle assembly according to an embodiment of the disclosure.
Figure 2:
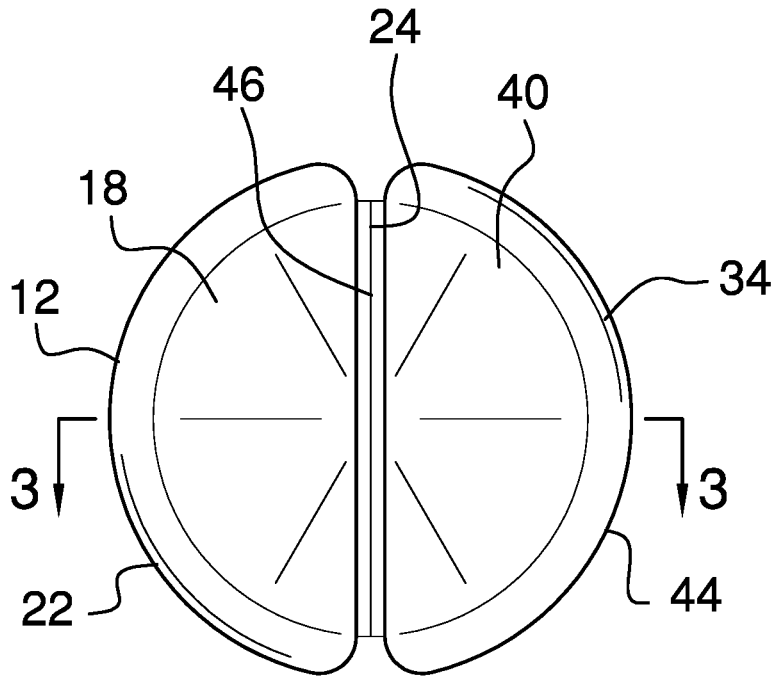
FIG. 2 is a bottom view of an embodiment of the disclosure.
Figure 3:
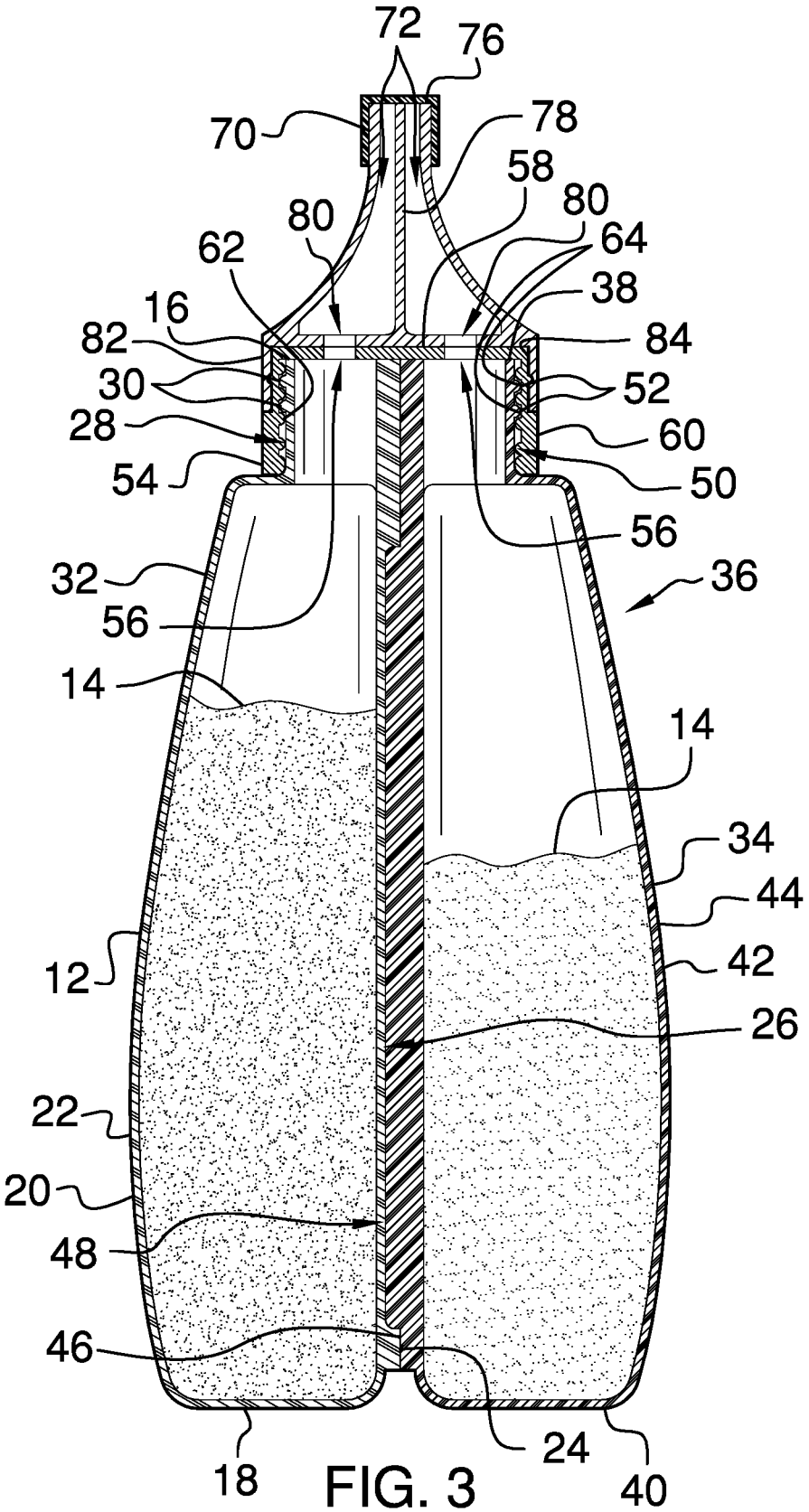
FIG. 3 is a cross sectional view taken along line 3-3 of FIG. 2 of an embodiment of the disclosure.
Figure 4:
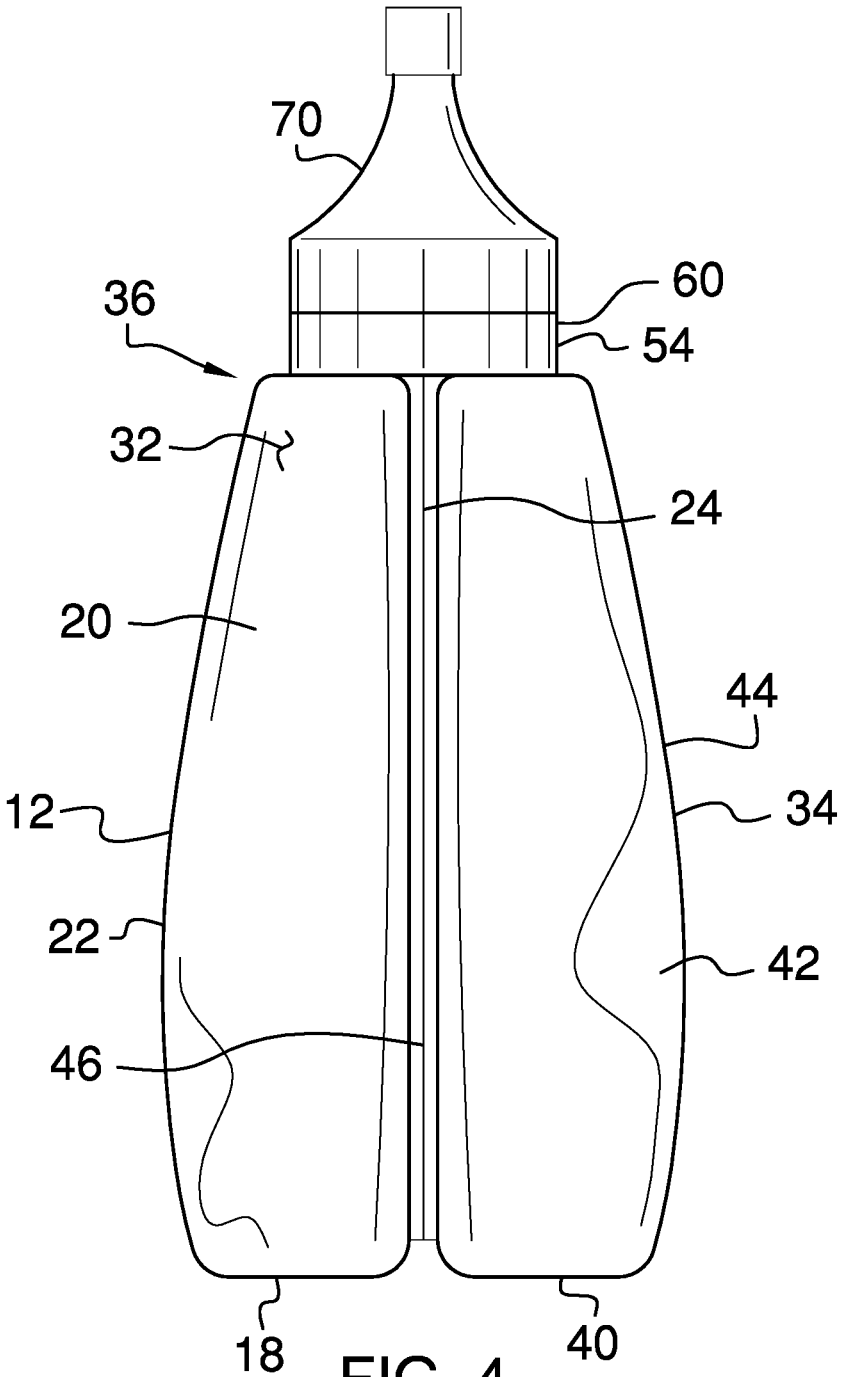
FIG. 4 is a front view of an embodiment of the disclosure.
Figure 5:
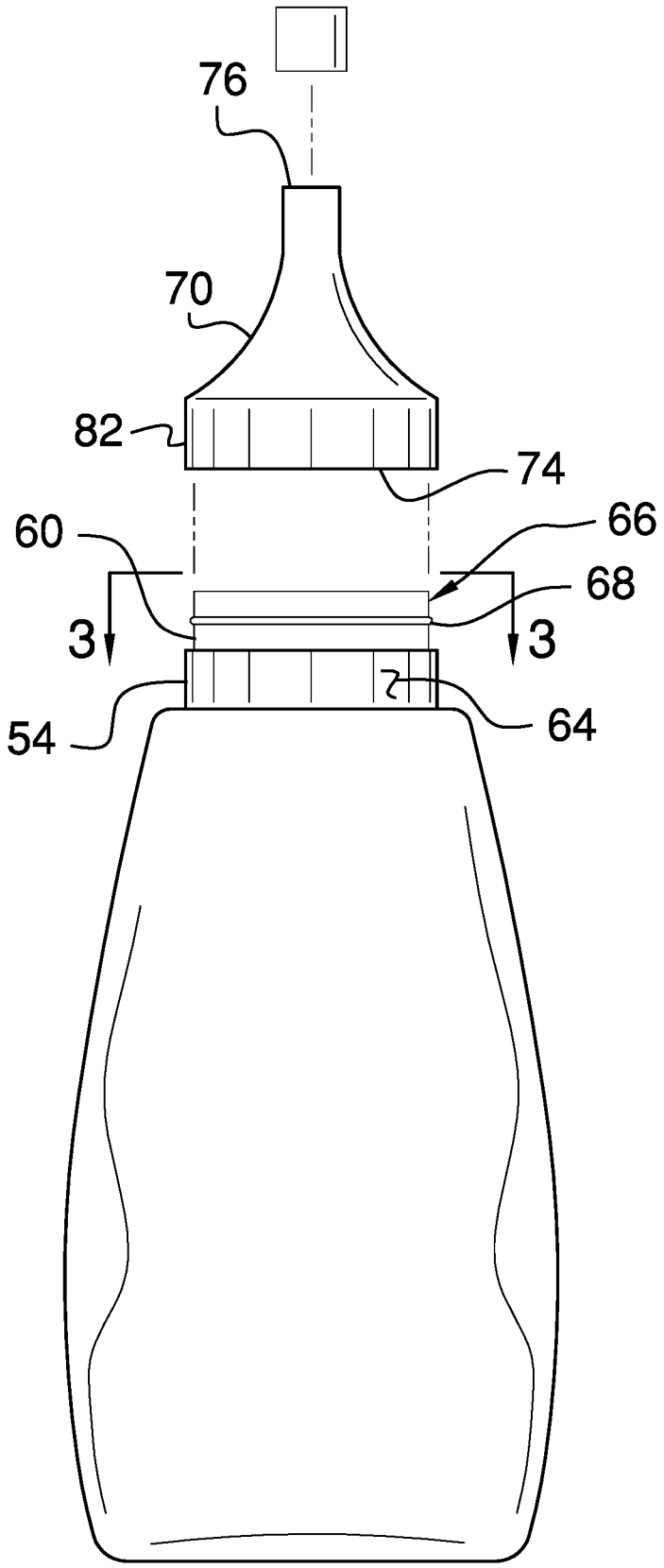
FIG. 5 is a right side exploded view of an embodiment of the disclosure.
Figure 6:
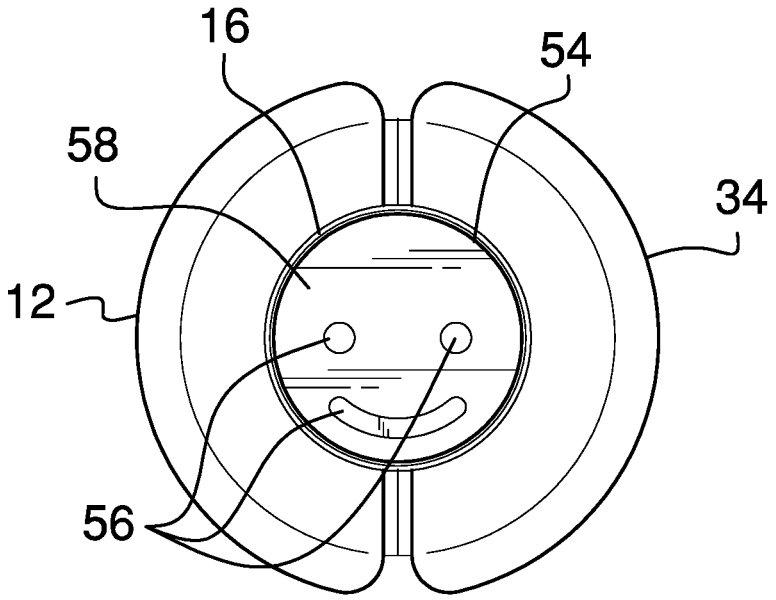
FIG. 6 is a cross sectional view taken along line 6-6 of FIG. 5 of an embodiment of the disclosure.

With reference now to the drawings, and in particular to FIGS. 1 through 6 thereof, a new condiment bottle device embodying the principles and concepts of an embodiment of the disclosure and generally designated by the reference numeral 10 will be described.

As best illustrated in FIGS. 1 through 6, the double chamber bottle assembly 10 generally comprises a first container 12 that contains a fluid condiment 14, such as ketchup or the like. The first container 12 has a top end 16, a bottom end 18 and an outer wall 20 extending therebetween, and the top end 16 is open. The outer wall 20 has a first lateral side 22 and a second lateral side 24, and the first lateral side 22 is concavely arcuate with respect to the second lateral side 24. The second lateral side 24 is flattened and the second lateral side 24 has a channel 26 extending inwardly toward the first lateral side 22. The channel 26 extends between the bottom end 18 and the top end 16.

The first lateral side 22 curves inwardly adjacent to the top end 16 to form a neck portion 28 of the first container 12. The outer wall 20 has a plurality of ridges 30 each extending outwardly from an outside surface 32 of the outer wall 20. The ridges 30 are spaced apart from each other and are vertically distributed on the neck portion 28.

A second container 34 is included and the second container 34 contains a fluid condiment 14, such as mustard or other condiment that is different from the fluid condiment 14 in the first container 12. The second container 34 releasably engages the first container 12 such that the first 12 and second 34 containers form a bottle 36. The second container 34 has an upper end 38, a lower end 40 and an outside wall 42 extending therebetween, and the upper end 38 is open. The outside wall 42 has a first lateral side 44 and a second lateral side 46, and the first lateral side 44 of the outside wall 42 is concavely arcuate with respect to the second lateral side 46 of the outside wall 42. The first lateral side 44 of the outside wall 42 is flattened and the first lateral side 44 of the outside wall 42 has a prominence 48 extending outwardly therefrom. The prominence 48 extends between the lower end 40 and the upper end 38 and the prominence 48 engages the channel 26 when the first 12 and second 34 containers form the bottle 36.

The first lateral side 22 curves inwardly adjacent to the upper end 38 to form a neck portion 50 on the outside wall 42. The outside wall 42 has a plurality of ridges 52 thereon and the ridges 52 on the outside wall 42 are spaced apart from each other and are vertically distributed on the neck portion 50 of the outside wall 42. Each of the ridges 52 on the second container 34 is aligned with respective ones of the ridges 30 on the first container 12 when the first 12 and second 34 containers form the bottle 36.

A cap 54 is rotatably coupled to each of the first 12 and second 34 containers and the cap 54 has a plurality of dispensing apertures 56 each extending therethrough. The cap 54 is rotatable into a first open position having a respective one of the dispensing apertures 56 being aligned with the first container 12. In this way the cap 54 releases the fluid condiment 14 from the first container 12. The cap 54 is rotatable into a second open position having a respective one of the dispensing apertures 56 being aligned with the second container 34. In this way the cap 54 releases the fluid condiment 14 from the second container 34. The cap 54 is rotatable into a third open position having a respective one of the dispensing apertures 56 being aligned with both of the first 12 and second 34 containers. In this way the cap 54 releases the fluid condiment 14 from both of the first 12 and second 34 containers. Additionally, the cap 54 is rotatable into a closed position.

The cap 54 has a top wall 58 and an exterior wall 60 extending downwardly therefrom, and the exterior wall 60 is continuously arcuate about a vertical axis of the cap 54. The exterior wall 60 has an inwardly facing surface 62 and the inwardly facing surface 62 has a plurality of grooves 64 therein. Each of the grooves 64 engages a respective one of the ridges 30, 52 on the first 12 and second 34 containers such that the cap 54 is rotatably retained on the bottle 36 formed by the first 12 and second 34 containers. Each of the dispensing apertures 56 extends through the top wall 58.

The dispensing aperture 56 that is associated with the third open position of the cap 54 is elongated and curves along an intersection between the top wall 58 and the exterior wall 60. The dispensing apertures 56 are spaced apart from each other and are distributed around the intersection between the top wall 58 and the exterior wall 60. An outwardly facing surface 64 of the exterior wall 60 has a recess 66 extending around an entire perimeter of the exterior wall 60. The recess 66 extends downwardly from the top wall 58 and the recess 66 has a ridge 68 extending outwardly therefrom. The ridge 68 on the recess 66 extends around an entire perimeter of the exterior wall 60.

A nozzle 70 is coupled to the cap 54 and the nozzle 70 has a pair of chambers 72 therein. Each of the chambers 72 is aligned with a respective one of the first 12 and second 34 containers to receive the fluid condiment 14 in the respective first 12 and second 34 containers. The nozzle 70 has a lower end 74 and an upper end 76, and the upper end 76 of the nozzle 70 is open. The nozzle 70 tapers inwardly between the lower 74 and upper 76 ends of the nozzle 70. A divider 78 is positioned within the nozzle 70 and the divider 78 extends between the lower 74 and upper 76 ends of the nozzle 70 to define each of the chambers 72 in the nozzle 70. The lower end 74 of the nozzle 70 has a pair of dispensing holes 80 each extending into a respective one of the chambers 72.

The nozzle 70 has a lip 82 extending downwardly from the lower end 40 of the nozzle 70 and the lip 82 extends around an entire circumference of the lower end 40 of the nozzle 70. The lip 82 has an inwardly facing surface 84 and the inwardly facing surface 84 of the lip 82 engages the ridge 68 on the recess 66 on the cap 54. Each of the dispensing holes 80 is aligned with a respective one of the dispensing apertures 56 in the cap 54 when the cap 54 is rotated into the first, second and third positions. In this way the nozzle 70 receives the fluid condiment 14 in each of the first 12 and second 34 containers.

In use, the cap 54 is rotated into the first position thereby aligning the respective dispensing aperture 56 in the cap 54 with the top end 16 of the first container 12 and the respective dispensing hole 80 in the nozzle 70. Thus, the fluid condiment 14 in the first container 12 can be dispensed from the nozzle 70. The cap 54 is rotated into the second position thereby aligning the respective dispensing aperture 56 in the cap 54 with the upper end 38 of the second container 34 and the respective dispensing hole 80 in the nozzle 70. In this way the fluid condiment 14 in the second container 34 can be dispensed from the nozzle 70.

The cap 54 is rotated into the third position thereby aligning the dispensing aperture 56 in the cap 54 that is associated with the third position with the top end 16 of the first container 12 and upper end 38 of the second container 34. Additionally, the dispensing aperture 56 in the cap 54 that is associated with the third position is aligned with each of the dispensing holes 80 in the nozzle 70. In this way the fluid condiment 14 in each of the first 12 and second 34 containers can be simultaneously dispensed from the nozzle 70. The cap 54 is rotated into the closed position to inhibit the fluid condiment 14 in either of the first 12 or second 34 containers from being dispensed from the nozzle 70.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A double chamber bottle assembly being configured to contain and dispense a pair of differing condiment, said assembly comprising:

a first container being configured to contain a fluid condiment, said first container having a top end, a bottom end and an outer wall extending therebetween, said top end being open, said outer wall having a first lateral side and a second lateral side, said first lateral side being concavely arcuate with respect to said second lateral side, said second lateral side being flattened, said second lateral side having a channel extending inwardly toward said first lateral side, said channel extending between said bottom end and said top end, said first lateral side curving inwardly adjacent to said top end to form a neck portion of said first container, said outer wall has a plurality of ridges each extending outwardly from an outside surface of said outer wall, said ridges being spaced apart from each other and being vertically distributed on said neck portion;

a second container being configured to contain a fluid condiment, said second container releasably engaging said first container such that said first and second containers form a bottle, said second container having an upper end, a lower end and an outside wall extending therebetween, said upper end being open, said outside wall having a first lateral side and a second lateral side, said first lateral side of said outside wall being concavely arcuate with respect to said second lateral side of said outside wall, said first lateral side of said outside wall being flattened, said first lateral side of said outside wall having a prominence extending outwardly therefrom, said prominence extending between said lower end and said upper end, said prominence engaging said channel when said first and second containers form said bottle, said first lateral side curving inwardly adjacent to said upper end to form a neck portion on said outside wall, said outside wall having a plurality of ridges thereon, said ridges on said outside wall being spaced apart from each other and being vertically distributed on said neck portion of said outside wall, each of said ridges on said second container being aligned with respective ones of said ridges on said first container when said first and second containers form said bottle;

a cap being rotatably coupled to each of said first and second containers, said cap having a plurality of dispensing apertures each extending therethrough, said cap being rotatable into a first open position having a respective one of said dispensing apertures being aligned with said first container wherein said cap is configured to release the fluid condiment from said first container, said cap being rotatable into a second open position having a respective one of said dispensing apertures being aligned with said second container wherein said cap is configured to release the fluid condiment from said second container, said cap being rotatable into a third open position having a respective one of said dispensing apertures being aligned with both of said first and second containers wherein said cap is configured to release the fluid condiment from both of the first and second containers, said cap being rotatable into a closed position, said cap having a top wall and an exterior wall extending downwardly therefrom, said exterior wall being continuously arcuate about a vertical axis of said cap, said exterior wall having an inwardly facing surface, said inwardly facing surface having a plurality of grooves therein, each of said grooves engaging a respective one of said ridges such that said cap is rotatably retained on said bottle formed by said first and second containers;

a nozzle being coupled to said cap, said nozzle having a pair of chambers therein, each of said chambers being aligned with a respective one of said first and second containers wherein each of said chambers is configured to receive the fluid condiment in said respective first and second containers; and an outwardly facing surface of said exterior wall having a recess extending around an entire perimeter of said exterior wall, said recess extending downwardly from said top wall, said recess having a ridge extending outwardly therefrom, said ridge on said recess extending around an entire perimeter of said exterior wall.

2. The assembly according to claim 1, wherein each of said dispensing apertures extends through said top wall, said dispensing aperture being associated with said third open position of said cap being elongated and curving along an intersection between said top wall and said exterior wall, said dispensing apertures being spaced apart from each other and being distributed around said intersection between said top wall and said exterior wall.

3. The assembly according to claim 1, wherein said nozzle has a lower end and an upper end, said upper end of said nozzle being open, said nozzle tapering inwardly between said lower and upper ends of said nozzle, said nozzle having a divider being positioned within said nozzle, said divider extending between said lower and upper ends of said nozzle to define each of said chambers in said nozzle.

4. The assembly according to claim 3, wherein said lower end of said nozzle has a pair of dispensing holes each extending into a respective one of said chambers.

5. The assembly according to claim 4, wherein said nozzle has a lip extending downwardly from said lower end of said nozzle, said lip extending around an entire circumference of said lower end of said nozzle, said lip having an inwardly facing surface, said inwardly facing surface of said lip engaging said ridge on said recess on said cap, each of said dispensing holes being aligned with a respective one of said dispensing apertures in said cap when said cap is rotated into said first, second and third positions wherein said nozzle is configured to receive the fluid condiment in each of said first and second containers.

6. A double chamber bottle assembly being configured to contain and dispense a pair of differing condiment, said assembly comprising:

a first container being configured to contain a fluid condiment, said first container having a top end, a bottom end and an outer wall extending therebetween, said top end being open, said outer wall having a first lateral side and a second lateral side, said first lateral side being concavely arcuate with respect to said second lateral side, said second lateral side being flattened, said second lateral side having a channel extending inwardly toward said first lateral side, said channel extending between said bottom end and said top end, said first lateral side curving inwardly adjacent to said top end to form a neck portion of said first container, said outer wall having a plurality of ridges each extending outwardly from an outside surface of said outer wall, said ridges being spaced apart from each other and being vertically distributed on said neck portion;

a second container being configured to contain a fluid condiment, said second container releasably engaging said first container such that said first and second containers form a bottle, said second container having a upper end, a lower end and an outside wall extending therebetween, said upper end being open, said outside wall having a first lateral side and a second lateral side, said first lateral side of said outside wall being concavely arcuate with respect to said second lateral side of said outside wall, said first lateral side of said outside wall being flattened, said first lateral side of said outside wall having a prominence extending outwardly therefrom, said prominence extending between said lower end and said upper end, said prominence engaging said channel when said first and second containers form said bottle, said first lateral side curving inwardly adjacent to said upper end to form a neck portion on said outside wall, said outside wall having a plurality of ridges thereon, said ridges on said outside wall being spaced apart from each other and being vertically distributed on said neck portion of said outside wall, each of said ridges on said second container being aligned with respective ones of said ridges on said first container when said first and second containers form said bottle;

a cap being rotatably coupled to each of said first and second containers, said cap having a plurality of dispensing apertures each extending therethrough, said cap being rotatable into a first open position having a respective one of said dispensing apertures being aligned with said first container wherein said cap is configured to release the fluid condiment from said first container, said cap being rotatable into a second open position having a respective one of said dispensing apertures being aligned with said second container wherein said cap is configured to release the fluid condiment from said second container, said cap being rotatable into a third open position having a respective one of said dispensing apertures being aligned with both of said first and second containers wherein said cap is configured to release the fluid condiment from both of the first and second containers, said cap being rotatable into a closed position, said cap having a top wall and an exterior wall extending downwardly therefrom, said exterior wall being continuously arcuate about a vertical axis of said cap, said exterior wall having an inwardly facing surface, said inwardly facing surface having a plurality of grooves therein, each of said grooves engaging a respective one of said ridges such that said cap is rotatably retained on said bottle formed by said first and second containers, each of said dispensing apertures extending through said top wall, said dispensing aperture being associated with said third open position of said cap being elongated and curving along an intersection between said top wall and said exterior wall, said dispensing apertures being spaced apart from each other and being distributed around said intersection between said top wall and said exterior wall, an outwardly facing surface of said exterior wall having a recess extending around an entire perimeter of said exterior wall, said recess extending downwardly from said top wall, said recess having a ridge extending outwardly therefrom, said ridge on said recess extending around an entire perimeter of said exterior wall; and a nozzle being coupled to said cap, said nozzle having a pair of chambers therein, each of said chambers being aligned with a respective one of said first and second containers wherein each of said chambers is configured to receive and subsequently dispense the fluid condiment in said respective first and second containers, said nozzle having a lower end and an upper end, said upper end of said nozzle being open, said nozzle tapering inwardly between said lower and upper ends of said nozzle, said nozzle having a divider being positioned within said nozzle, said divider extending between said lower and upper ends of said nozzle to define each of said chambers in said nozzle, said lower end of said nozzle having a pair of dispensing holes each extending into a respective one of said chambers, said nozzle having a lip extending downwardly from said lower end of said nozzle, said lip extending around an entire circumference of said lower end of said nozzle, said lip having an inwardly facing surface, said inwardly facing surface of said lip engaging said ridge on said recess on said cap, each of said dispensing holes being aligned with a respective one of said dispensing apertures in said cap when said cap is rotated into said first, second and third positions wherein said nozzle is configured to receive the fluid condiment in each of said first and second containers.

* * * * *